US010505266B2

(12) United States Patent
Taira et al.

(10) Patent No.: US 10,505,266 B2
(45) Date of Patent: Dec. 10, 2019

(54) ANTENNA DEVICE

(71) Applicant: HARADA INDUSTRY CO., LTD., Tokyo (JP)

(72) Inventors: Kenji Taira, Tokyo (JP); Ayaka Suzuki, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 17 days.

(21) Appl. No.: 16/017,639

(22) Filed: Jun. 25, 2018

(65) Prior Publication Data

US 2019/0006744 A1 Jan. 3, 2019

(30) Foreign Application Priority Data

Jul. 3, 2017 (JP) ..... 2017-130085

(51) Int. Cl.
*H01Q 1/32* (2006.01)
*H01Q 1/38* (2006.01)

(52) U.S. Cl.
CPC ..... *H01Q 1/3275* (2013.01); *H01Q 1/38* (2013.01)

(58) Field of Classification Search
CPC ..... H01Q 1/32; H01Q 1/38
USPC ..... 343/702
See application file for complete search history.

(56) References Cited

U.S. PATENT DOCUMENTS

2018/0034142 A1* 2/2018 Nishikawa ..... H01Q 1/1214

FOREIGN PATENT DOCUMENTS

JP 2013-229813 A 11/2013

* cited by examiner

*Primary Examiner* — Andrea Lindgren Baltzell
(74) *Attorney, Agent, or Firm* — Global IP Counselors, LLP

(57) ABSTRACT

An antenna device includes an antenna base, an antenna case, an antenna element and an elastic member. The antenna base includes an opening and a plurality of first fitting portions located at an interval from each other at a side wall of the opening; an antenna case secured to a first surface side of the antenna base. The antenna element is located in a space enclosed by the antenna base and the antenna case. The elastic member includes a plurality of second fitting portions fittable with the plurality of first fitting portions and a rib provided on a second surface side opposite to the first surface side and protruding in a direction away from the antenna base.

20 Claims, 15 Drawing Sheets

ANTENNA DEVICE

CROSS REFERENCE TO RELATED APPLICATIONS

This application is based on and claims the benefit of priority from the prior Japanese Patent Application No. 2017-130085, filed on Jul. 3, 2017, the entire contents of which are incorporated herein by reference.

FIELD

The present invention relates to an antenna device, and an embodiment of the invention disclosed herein relates to a sealing structure of the antenna device.

BACKGROUND

Conventionally, a vehicle-mounted antenna device includes an antenna base, a cover covering the antenna base, and an antenna element and a circuit board accommodated in a space enclosed by the antenna base and the cover. In order to prevent the antenna element and the circuit board from being wet by moisture entering from outside, there is a technology of providing a sealing member enclosing the entirety of an outer perimeter of the antenna base (e.g., Japanese Laid-Open Patent Publication No. 2013-229813). The sealing member disclosed in Japanese Laid-Open Patent Publication No. 2013-229813 is secured, with an adhesive, a two-sided tape or the like, to a groove provided around a recessed portion that is located at a center of the antenna base and accommodates the circuit board.

SUMMARY

An antenna device in an embodiment according to the present invention includes an antenna base including an opening and a plurality of first fitting portions located at an interval from each other at a side wall of the opening; an antenna case secured to a first surface side of the antenna base; an antenna element located in a space enclosed by the antenna base and the antenna case; and an elastic member including a plurality of second fitting portions fittable with the plurality of first fitting portions and a rib provided on a second surface side opposite to the first surface side and protruding in a direction away from the antenna base.

The plurality of first fitting portions of the antenna base may be provided on the first surface side, at the side wall of the opening.

The plurality of first fitting portions may be protrusions provided on the side wall of the opening. The plurality of second fitting portions may be through-holes or recessed portions fittable with the protrusions. In this case, the plurality of first fitting portions may be locked with the plurality of second fitting portions.

In addition, the plurality of first fitting portions (protrusions) may each have a width varying in accordance with the position in a first direction in which the plurality of second fitting portions are pressed into the plurality of first fitting portions. The plurality of second fitting portions (through-holes or recessed portions) may each have a diameter of the through-hole or a width of the recessed portion varying in accordance with the position in the first direction.

The plurality of first fitting portions may be recessed portions provided at the side wall of the opening. The plurality of second fitting portions may be protrusions fittable with the recessed portions. In this case, the plurality of second fitting portions may be locked with the plurality of first fitting portions.

In addition, the plurality of first fitting portions (recessed portions) each have a width varying in accordance with the position in a first direction in which the plurality of second fitting portions (protrusions) are pressed into the plurality of first fitting portions. The plurality of second fitting portions may each have a width varying in accordance with the position in the first direction.

According to one embodiment of the present invention, an antenna device that has a higher level of adhesiveness between the sealing member (elastic member) and the antenna base to suppress a gap from being made between the sealing member and the antenna base can be provided.

BRIEF DESCRIPTION OF DRAWINGS

Referring to the drawings which form a part of the present disclosure, various embodiments of antenna devices are illustrated as follows.

DESCRIPTION OF EMBODIMENTS

Figure 1:
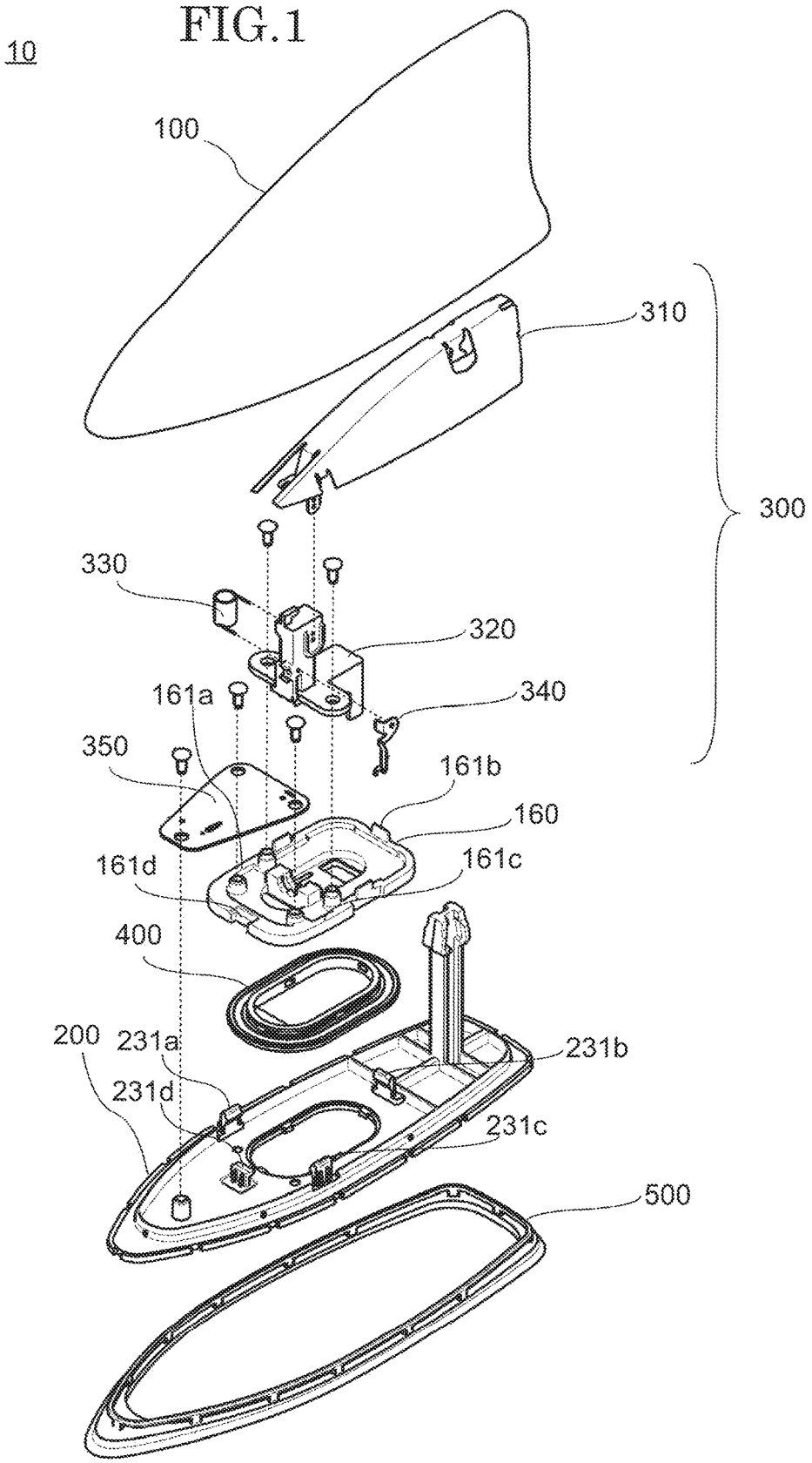
FIG. 1 is an exploded perspective view of an antenna device in accordance with a first embodiment.

Regarding the technology disclosed in Japanese Laid-Open Patent Publication No. 2013-229813, when the adhesive or the like securing the sealing member is deteriorated, the adhesiveness between the sealing member and the antenna base is declined. Namely, when the adhesive or the like is deteriorated, there may occur a problem that a gap may be made between the sealing member and the antenna base, or that the sealing member may be delaminated from the antenna base. When such a gap is made between the sealing member and the antenna base, or when the sealing member is delaminated from the antenna base, there is an undesirable possibility that moisture enters the inside of the antenna device from outside.

The present invention, made to solve such a problem of the conventional art, has an object of providing an antenna device that has a higher level of adhesiveness between the sealing member (elastic member) and the antenna base to suppress a gap from being made between the sealing member and the antenna base.

Hereinafter, embodiments of the present invention will be described with reference to the drawings. The following embodiments are mere examples of the present invention, and the present invention is not limited to any of the following embodiments. In the drawings referred to in the following embodiments, components that are the same or have substantially the same functions as those described before with reference to a previous drawing(s) bear the identical reference signs or similar reference signs (identical reference signs followed by letters "A", "B" or the like), and the descriptions thereof may not be repeated. For the sake of convenience, the terms "top (up)" and "bottom (down)" will be used. The terms "top (up)" and "bottom (down)" represent directions in a state where the antenna device is attached to a vehicle. The terms "front" and "rear" will be used. The term "front" represents an advancing direction of the vehicle, and the term "rear" represents a direction in which the vehicle advances backward. The term "lateral direction" will be used. The term "lateral direction" represents a direction perpendicular to the advancing direction of the vehicle.

First Embodiment

With reference to FIG. 1 to FIG. 5, an antenna device 10 in the first embodiment according to the present invention will be described. The antenna device 10 in the first embodiment according to the present invention is an antenna device attachable to a roof of a vehicle, and has a streamlined shape that becomes narrower toward the front tip thereof. An antenna device of such a shape is generally referred to as a "shark fin antenna". In the following embodiments, an antenna device attachable to a roof of a vehicle will be described. Nonetheless, the antenna device is not limited to being attachable to the roof of the vehicle. For example, the antenna device in each of the following embodiments is attachable to a spoiler, a trunk cover or the like as well as the roof of the vehicle.

Overview of the Antenna Device

First, with reference to FIG. 1, an overview of the antenna device 10 will be described. FIG. 1 is an exploded perspective view of the antenna device 10 in the first embodiment according to the present invention.

As shown in FIG. 1, the antenna device 10 includes an antenna case 100, an antenna base 200, an antenna portion 300, a ground base 160, an elastic member 400, and a base pad 500. The antenna case 100 covers the antenna portion 300, the ground base 160 and the elastic member 400, and is secured to the antenna base 200 by, for example, welding, bonding or the like. The antenna case 100 and the antenna base 200 protect the antenna portion 300 against an external pressure, impact, moisture, dust or the like. An element 310 (antenna element), an element holder 320, an amplifier substrate 350 and the like are provided on the ground base 160 so as to be accommodated in the antenna case 100. A bolt (not shown) usable to attach the antenna device 10 to a vehicle protrudes from a bottom surface of the antenna base 200.

The antenna portion 300 includes the element (antenna element) 310, the element holder 320, a coil 330, a power supply terminal 340 and the amplifier substrate 350. The element 310 and the coil 330 are held by the element holder 320. A lead extending from a top end of the coil 330 is connected with a terminal of the element 310. A lead extending from a bottom end of the coil 330 is connected with the power supply terminal 340. As shown in FIG. 1, the power supply terminal 340 is bent, and a top portion thereof is secured to a frame of the element holder 320. A terminal at a bottom end of the power supply terminal 340 is connected with the amplifier substrate 350. With such an arrangement, an AM/FM signal received by the element 310 is input to the amplifier substrate 350 via the coil 330, and is amplified by an amplifier incorporated into the amplifier substrate 350.

Structure of the Antenna Base

Figure 2:
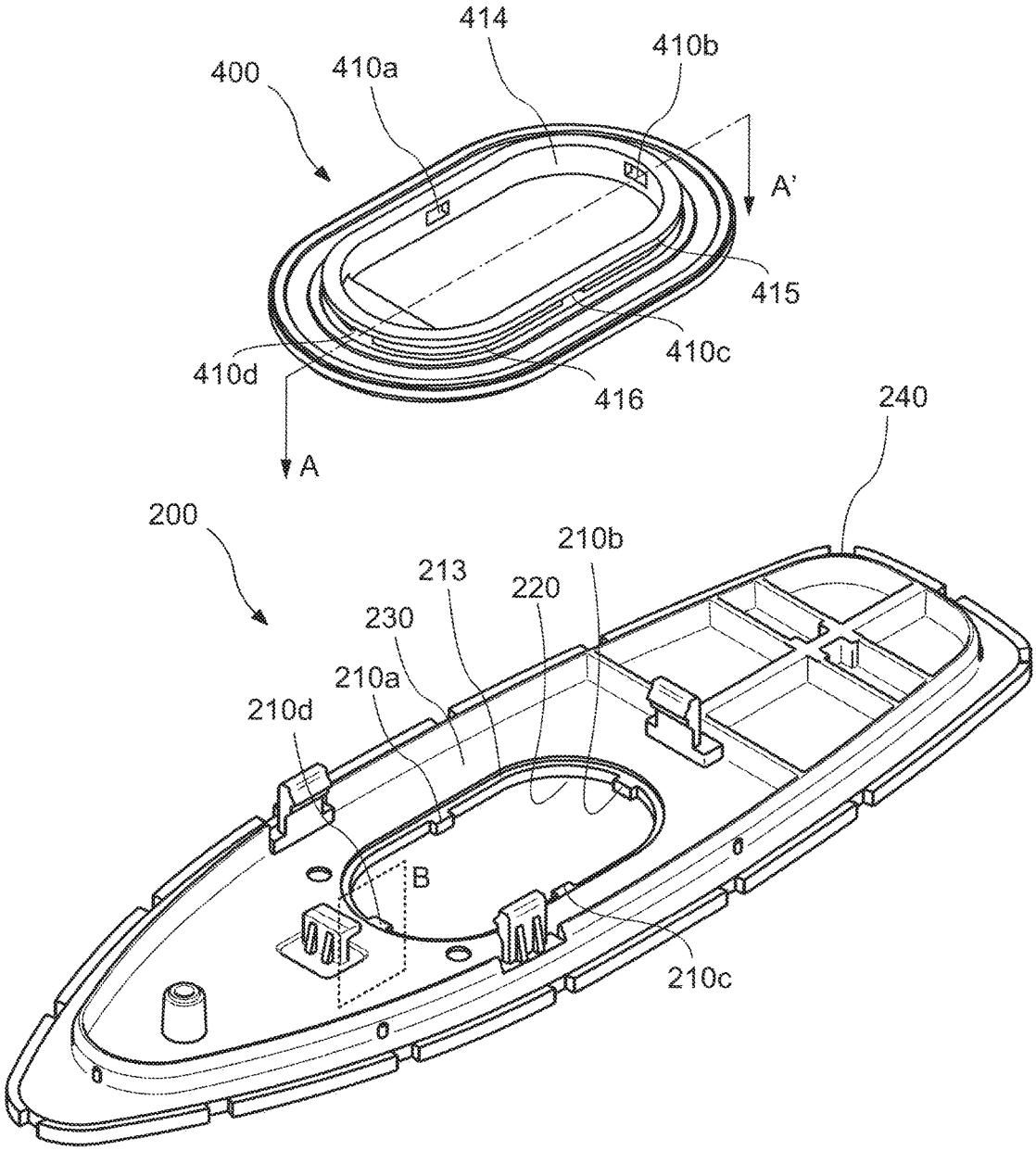
FIG. 2 is a perspective view of an antenna base and an elastic member of the antenna device in accordance with the first embodiment.
Figure 3:
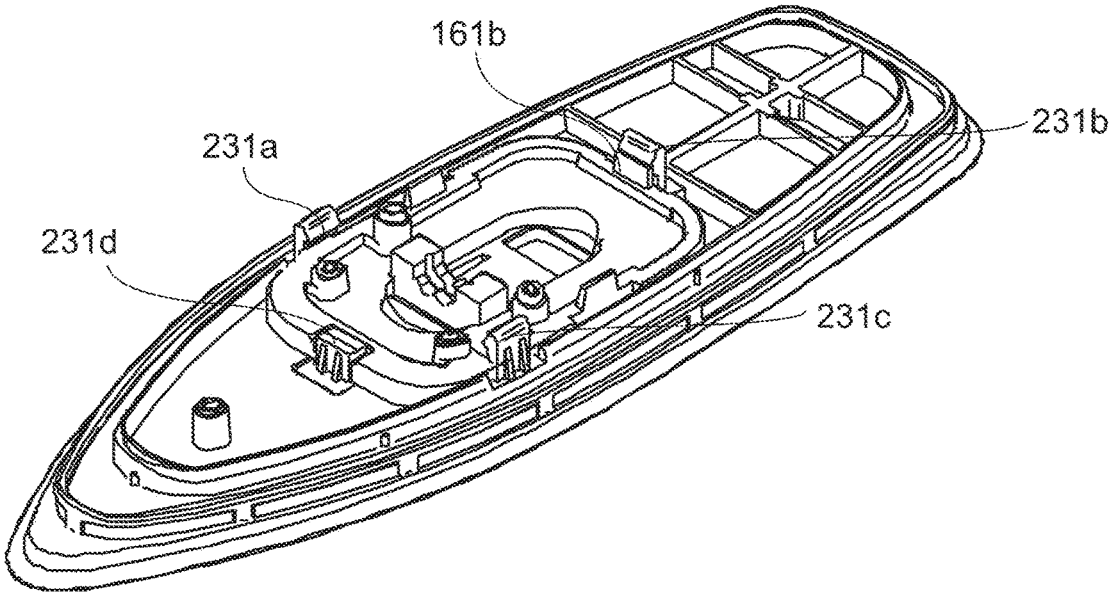
FIG. 3 is a perspective view of the antenna base having a ground base secured thereto in the antenna device in accordance with the first embodiment.
Figure 4A:
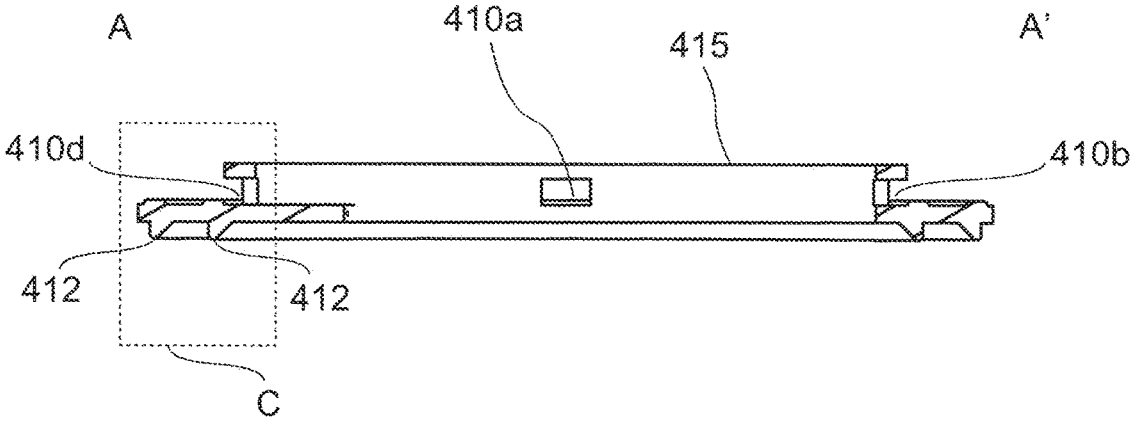
FIG. 4A is a cross-sectional view of the elastic member shown in FIG. 2 taken along line A-A' in FIG. 2.
Figure 4B:
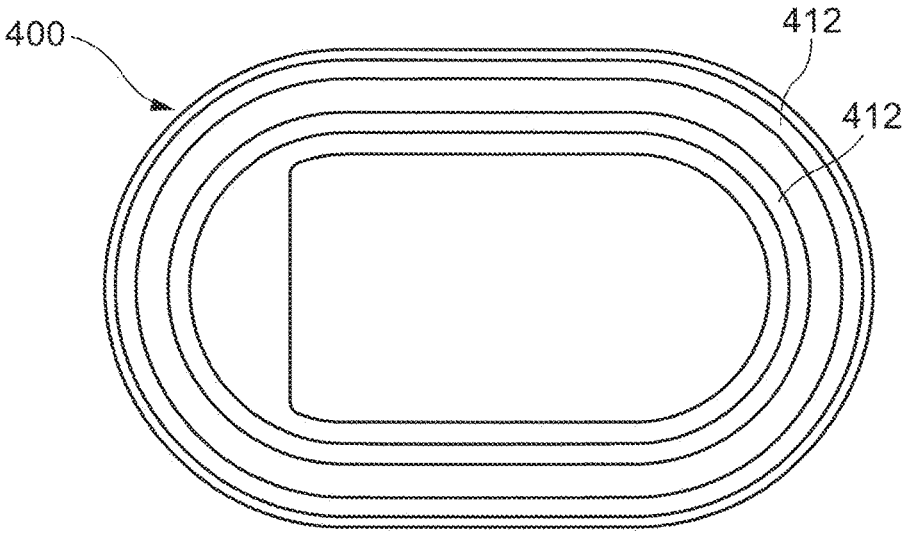
FIG. 4B is a bottom view of the elastic member shown in FIG. 2.
Figure 5:
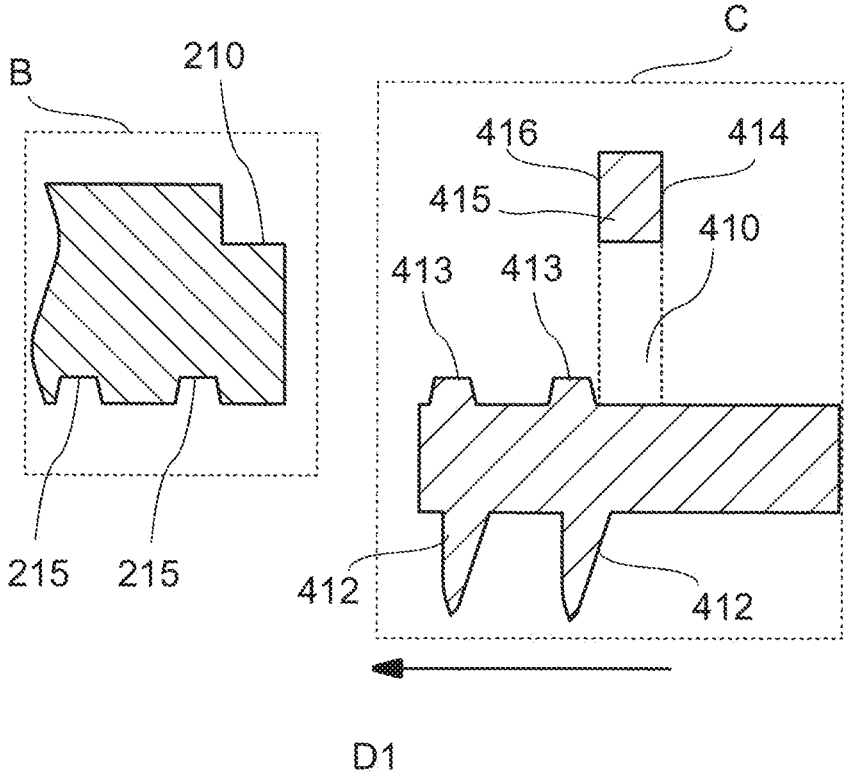
FIG. 5 is a cross-sectional view of a first fitting portion of the antenna base and a second fitting portion of the elastic member in the antenna device in accordance with the first embodiment, in the state before the first fitting portion and the second fitting portion are fit with each other.

Now, with reference to FIG. 2 to FIG. 5, structures of the antenna base 200 and the elastic member 400 included in the antenna device 10 will be described in detail. FIG. 2 is a perspective view of the antenna base 200 and the elastic member 400 in the antenna device 10 in the first embodiment according to the present invention. FIG. 3 is a perspective view of the antenna base 200 having the ground base 160 secured thereto in the antenna device 10 in the first embodiment according to the present invention. FIG. 4A is a cross-sectional view of the elastic member 400 shown in FIG. 2 taken along line A-A' in FIG. 2. FIG. 4B is a bottom view of the elastic member 400. FIG. 5 is a cross-sectional view of the antenna device 10 in the first embodiment according to the present invention; more specifically, a cross-sectional view of a first fitting portion 210 of the antenna base 200 and a second fitting portion 410 of the elastic member 400, in the state before the first fitting portion 210 and the second fitting portion 310 are fit with each other. For the sake of convenience, FIG. 5 shows, in enlargement, a portion where the first fitting portion 210 and the second fitting portion 410 are fit with each other. Specifically, FIG. 5 provides a partial enlarged view of area B, shown in FIG. 2, including the first fitting portion 210*d* and the vicinity thereof, and a partial enlarged view of area C, shown in FIG. 4A, including the second fitting portion 410*d* and the vicinity thereof. FIG. 6 to FIG. 14 referred to below each provide such enlarged views.

As shown in FIG. 2, the antenna base 200 includes first fitting portions 210*a* to 210*d*, an opening 220, a ground base setting region 230, and a circumferential wall 240. The antenna base 200 is formed of a radio wave-transmissive synthetic resin. It is preferred that the antenna base 200 is sufficiently rigid to hold the ground base 160. The ground base 160 is formed of a conductive material, for example, a metal material such as a zinc alloy, an aluminum alloy or the like.

The circumferential wall 240 is located outer to the ground base setting region 230, and protrudes upward from the ground base setting region 230. The circumferential wall 240 is located at a position at which, in the state where the antenna case 100 is assembled with the antenna base 200, the circumferential wall 240 may contact a part of the antenna case 100.

The opening 220 runs through the antenna base 200 from a top surface (first surface) to a bottom surface (second surface) thereof, and is provided inner to the circumferential wall 240. A power supply line supplying power to the amplifier substrate 350, an antenna cable transmitting a signal from the antenna portion 300 and the like are inserted through the opening 220 and are connected with the vehicle side. A signal received by the antenna portion 300 is transmitted to a tuned circuit (radio tuner, etc. (not shown)) provided on the vehicle side via the antenna cable. As described below, the elastic member 400 suppressing entrance of external moisture, dust or the like into the ground base setting region 230 is provided on a side wall (inner circumferential portion) of the opening 220.

The ground base setting region 230 is a flat plate-like region provided inner to the circumferential wall 240. The ground base 160 is set on the ground base setting region 230. As shown in FIG. 3, the ground base setting region 230 includes engaging portions 231*a* to 231*d* (hereinafter, referred to as "engaging portion(s) 231" in the case where the engaging portions 231*a* to 231*d* are not specifically distinguished from each other) usable to secure the ground base 160 to the ground base setting region 230. In this example, engageable portions 161*a* to 161*d* (hereinafter, referred to as "engageable portion(s) 161" in the case where the engageable portions 161*a* to 161*d* are not specifically distinguished from each other) of the ground base 160 shown in FIG. 1 are respectively engaged with the engaging portions 231*a* to 231*d*. In this example, the antenna base 200 includes such components that put the ground base 160 into engagement therewith, or secure the ground base 160. It should be noted that as long as a specific positional relationship is fulfilled, the antenna base 200 may include components that put the ground base 160 into engagement therewith, or secure the ground base 160, or alternatively, the ground base 160 may include components that put the antenna base 200 into engagement therewith, or secure the antenna base 200. A first groove 213 is provided to be recessed from the ground setting region 230. The first groove 213 is located along the opening 220.

The fitting portions 210*a* to 210*d* (hereinafter, referred to as "fitting portion(s) 210" in the case where the fitting portions 210*a* to 210*d* are not specifically distinguished from each other) are provided on the side wall of the opening 220 at an interval from each other. In the example shown in FIG. 2, there are four first fitting portions 210. However, the number of the first fitting portions 210 is not limited to four. In this embodiment, the first fitting portions 210 are protrusions protruding inward into the opening 220. Thus, in this embodiment, the first fitting portions 210 may be referred to as "first protrusions 210".

The elastic members 400 includes a wall portion 415 at a top surface (surface facing the bottom surface of the antenna base 200). The wall portion 415 is located to face the inner wall of the opening 220 of the antenna base 200. The wall portion 415 has second fitting portions 410*a* to 410*d* (hereinafter, referred to as "fitting portion(s) 410" in the case where the fitting portions 410*a* to 410*d* are not specifically distinguished from each other). The second fitting portions 410 are provided to run through the wall portion 415 from an inner wall 414 to an outer wall 416. The second fitting portions 410 are provided as holes from the inner wall 414 to the outer wall 416, and thus may be referred to as "through-holes 410". The elastic member 400 may be formed of an elastic material such as rubber or the like.

The second fitting portions 410 are fit with the first fitting portions 210. In the example shown in FIG. 2, the second fitting portion 410*a* is fit with the first fitting portion 210*a*. The second fitting portion 410*b* is fit with the first fitting portion 210*b*. The second fitting portion 410*c* is fit with the first fitting portion 210*c*. The second fitting portion 410*d* is fit with the first fitting portion 210*d*. The second fitting portions 410*a* to 410*d* are respectively located in positional correspondence with the first fitting portions 210*a* to 210*d* in order to be fit with the first fitting portions 210*a* to 210*d*.

The elastic member 400 includes ribs 412 at a bottom surface thereof (surface opposite to the surface at which the wall portion 415 is provided). As shown in FIG. 4A, in the state where the elastic member 400 is assembled with the antenna base 200, the ribs 412 protrude downward (i.e., in a direction away from the antenna base 200). Namely, in the state where the antenna device 10 is attached to the vehicle (not shown), the ribs 412 protrude toward the vehicle. As is clear from FIG. 2, FIG. 4A and FIG. 4B, the ribs 412 are located in a ring shape so as to enclose the wall portion 415 as seen in a plan view, in the state where the elastic member 400 is assembled with the antenna base 200. Namely, the ribs 412 are located to enclose the opening 220 of the antenna base 200. The ribs 412 are pressed onto the roof or the like of the vehicle, and thus prevents moisture from entering the inside of the antenna device 10 from outside. As can be seen, the elastic member 400 plays a role of preventing moisture from entering the inside of the antenna device 10 from outside. In other words, the elastic member 400 acts as a sealing member. In this example, the elastic member 400 is ring-shaped, and thus may be referred to as a "water-proof ring". The shape of the elastic member 400 may be changed optionally.

FIG. 5 is a cross-sectional view of one of the first fitting portions 210 and the corresponding second fitting portion 410 in the state before the first fitting portion and the second fitting portion are fit with each other. The fitting mechanism is the same for the four first fitting portions 210 and the four second fitting portions 410 as shown in FIG. 2, and will be described regarding one pair of the first fitting portion 210 and the second fitting portion 410. As shown in FIG. 5, the second fitting portion 410 is moved in a D1 direction (first direction), so that the first fitting portion 210 and the second fitting portion 410 are fit with each other. When the first fitting portion 210 and the second fitting portion 410 are fit with each other in this manner, the elastic member 400 and the antenna base 200 contact each other also at the portion where the first fitting portion 210 and the second fitting portion 410 are fit with each other. In this embodiment, the contact area size of the elastic member 400 and the antenna base 200 is increased than in the conventional art by the portion where the first fitting portion 210 and the second fitting portion 410 are fit with each other. In addition, as described above, in this embodiment, the engaging portions 231 of the antenna base 200 are engaged with, and secure, the engageable portions 161 of the ground base 160. At this point, a part of the elastic member 400 (e.g., the wall portion 415) is located between the antenna base 200 and the ground base 160. As a result of the engaging portions 231 of the antenna base 200 being engaged with, and securing, the engageable portions 161 of the ground base 160, the part of the elastic member 400 is held and pressed between the ground base 160 and the antenna base 200. Therefore, the adhesiveness between the elastic member 400 and the antenna base 200 is improved, so that generation of a gap between the elastic member 400 and the antenna base 200 is suppressed, or the elastic member 400 is suppressed from being delaminated from the antenna base 200. In this embodiment, the second fitting portion 410 is a through-hole. Therefore, in the state where the first fitting portion 210 and the second fitting portion 410 are fit with each other, the first fitting portion 210 is visually recognizable from the side of the inner wall 414. This allows an operator to visually check whether or not the first fitting portion 210 and the second fitting portions 410 are fit with each other.

As described above, in this example, four first fitting portions 210 are provided, and four second fitting portions 410 are provided in correspondence with the first fitting portions 210. As the number of the fitting portions is increased, the contact area size of the elastic member 400 and the antenna base 200 is increased, and the adhesiveness between the elastic member 400 and the antenna base 200 is improved. However, the first fitting portions 210 and the second fitting portions 410 are caused to fit with each other by an operator. Therefore, as the number of the fitting portions is increased, the operation time is extended and the operation cost is raised. Namely, the number of the first fitting portions 210 and the second fitting portions 410 (adhesiveness level) and the operation cost are in a trade-off relationship. In such a situation, the number of the first fitting portions 210 and the second fitting portions 410 is appropriately determined in consideration of the operation cost.

As shown in FIG. 5, the elastic member 400 includes two protrusions 413 protruding oppositely from the ribs 412. Since there are two protrusions 413, a portion between the protrusions 413 may be referred to as a "groove". Meanwhile, the antenna base 200 has two recessed portions 215 in the bottom surface (second surface). The two protrusions 413 of the elastic member 400 and the two recessed portions 215 of the antenna base 200 are located so as to be fit with each other in the state where the elastic member 400 and the antenna base 200 are assembled together. The protrusions 413 and the recessed portion 215 are shaped to be fit with each other.

First Modification of First Embodiment

Figure 6:
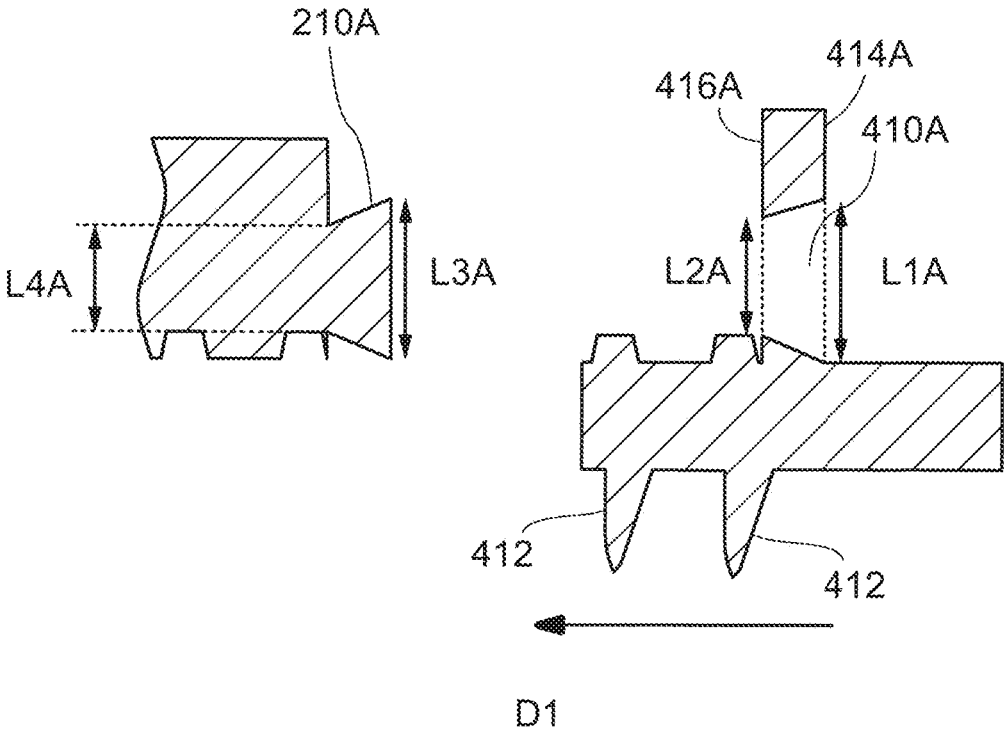
FIG. 6 is a cross-sectional view of a first fitting portion of an antenna base and a second fitting portion of an elastic member in an antenna device in a first modification of the first embodiment, in the state before the first fitting portion and the second fitting portion are fit with each other.

In the first embodiment, as shown the cross-sectional view of FIG. 5, the first fitting portion 210, which is a protrusion, and the second fitting portion 410 are both rectangular. The first fitting portion 210 or the second fitting portion 410 is not limited to being rectangular. With reference to FIG. 6, the first modification will be described. FIG. 6 is a cross-sectional view of an antenna device in the first modification of the first embodiment; more specifically, a cross-sectional view of a first fitting portion 210A of the antenna base 200 and a second fitting portion 410A of the elastic member 400, in the state before the first fitting portion 210A and the second fitting portion 410A are fit with each other. Regarding the first modification, differences from the first embodiment will be described, and the components same as those in the first embodiment will not be described.

As shown in FIG. 6, in the first modification, as seen in a cross-sectional view, the first fitting portion 210A, which is a protrusion, is trapezoidal. Specifically, as seen in a cross-sectional view, width L3A at a tip end is wider than width L4A at a base end. In other words, the width of the first fitting portion 210A varies in the D1 direction, more specifically, varies in accordance with the position in the D1 direction. Similarly, as seen in a cross-sectional view, the second fitting portion 410A is trapezoidal. Specifically, as seen in a cross-sectional view, width L1A at an inner wall 414A is wider than width L2A at an outer wall 416A. In other words, the width of the second fitting portion 410A varies in accordance with the position in the D1 direction.

Width L3A is wider than width L2A. Therefore, in order to cause the first fitting portion 210A and the second fitting portion 410A to be fit with each other, the elastic member 400 having the second fitting portion 410A needs to be pressed in the D1 direction. The elastic member 400 having the second fitting portion 410A is pressed in the D1 direction, so that a shape of the second fitting portion 410A is elastically deformed. As a result, the first fitting portion 210A and the second fitting portion 410A are fit with each other. In this case, when the first fitting portion 210A and the second fitting portion 410A are fit with each other, the elastic member 400 having the second fitting portion 410A is locked with the first fitting portion 210A and thus is suppressed from coming off from the first fitting portion 210A.

This modification provides substantially the same effect as that of the first embodiment. In addition, in order to cause the first fitting portion 210A and the second fitting portion 410A to be fit with each other, the operator needs to press the elastic member 400 having the second fitting portion 410A in the D1 direction. Therefore, the operator can perceive by touch whether or not the first fitting portion 210A and the second fitting portion 410A are fit with each other. Moreover, when the first fitting portion 210A and the second fitting portion 410A are fit with each other, the elastic member 400 having the second fitting portion 410A is locked with the first fitting portion 210A and thus is suppressed from coming off from the first fitting portion 210A.

Second Modification of First Embodiment

Figure 7:
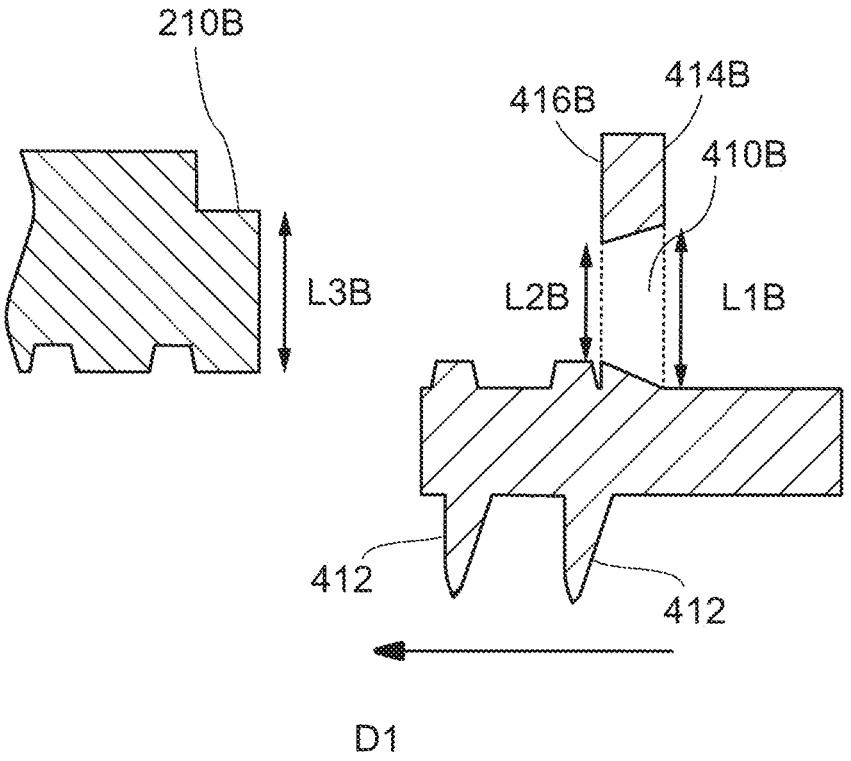
FIG. 7 is a cross-sectional view of a first fitting portion of an antenna base and a second fitting portion of an elastic member in an antenna device in a second modification of the first embodiment, in the state before the first fitting portion and the second fitting portion are fit with each other.
Figure 8:
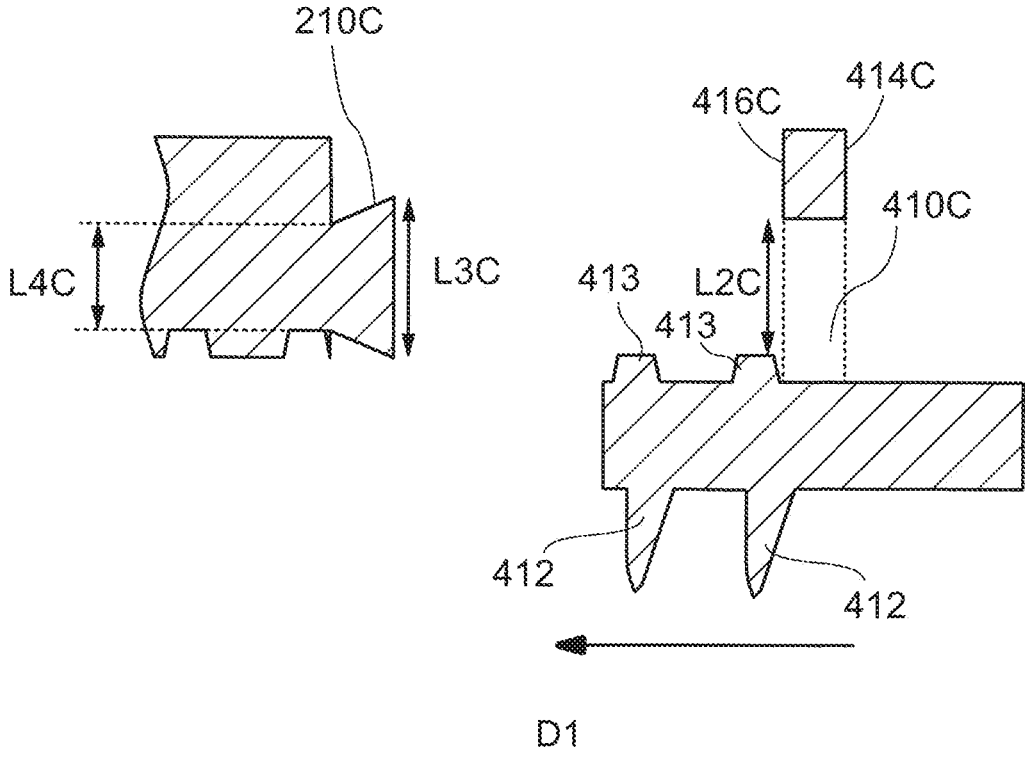
FIG. 8 is a cross-sectional view of a first fitting portion of an antenna base and a second fitting portion of an elastic member in the antenna device of the second modification of the first embodiment, in the state before the first fitting portion and the second fitting portion are fit with each other.

With reference to FIG. 7 and FIG. 8, an antenna device in the second modification of the first embodiment will be described. FIG. 7 is a cross-sectional view of the antenna device in the second modification of the first embodiment; more specifically, a cross-sectional view of a first fitting portion 210B of the antenna base 200 and a second fitting portion 410B of the elastic member 400, in the state before the first fitting portion 210B and the second fitting portion 410B are fit with each other. FIG. 8 is a cross-sectional view of the antenna device in the second modification of the first embodiment; more specifically, a cross-sectional view of a first fitting portion 210C of the antenna base 200 and a second fitting portion 410C of the elastic member 400, in the state before the first fitting portion 210C and the second fitting portion 410C are fit with each other. Regarding the second modification, differences from the first embodiment or the first modification will be described, and the components same as those in the first embodiment or the first modification will not be described.

In this modification, as shown in FIG. 7 and FIG. 8, one of the first fitting portion and the second fitting portion has a width that varies in accordance with the position in the D1 direction. Specifically, in FIG. 7, the width of the second fitting portion 410B varies in accordance with the position in the D1 direction. In FIG. 8, the width of the first fitting portion 210C varies in accordance with the position in the D1 direction. Namely, the other of the first fitting portion and the second fitting portion has a width that is constant in the D1 direction. Specifically, in FIG. 7, the width of the first fitting portion 210B is constant in the D1 direction. In FIG. 8, the width of the second fitting portion 410C is constant in the D1 direction. As shown in FIG. 7, width L2B of the second fitting portion 410B at an outer wall 4161 is narrower than width L3B of the first fitting portion 210B. As shown in FIG. 8, width L2C of the second fitting portion 410C between an outer wall 416C and the protrusion 413 is narrower than width L3C at a tip end of the first fitting portion 210C. With such an arrangement, the elastic member 400 having the second fitting portion 410B is elastically deformed to be fit with the first fitting portion 210B, and is recovered from the deformed state when being fit with the first fitting portion 210B. A shape of the second fitting portion 410C is elastically deformed to be fit with the first fitting portion 210C, and is recovered from the deformed state when being fit with the first fitting portion 210C. As a result, the elastic member 400 having the second fitting portion 410B is locked with the first fitting portion 210B. The elastic member 400 having the second fitting portion 410C is locked with the first fitting portion 210C. This modification provides substantially the same effect as that of the first modification.

Third Modification of First Embodiment

Figure 9:
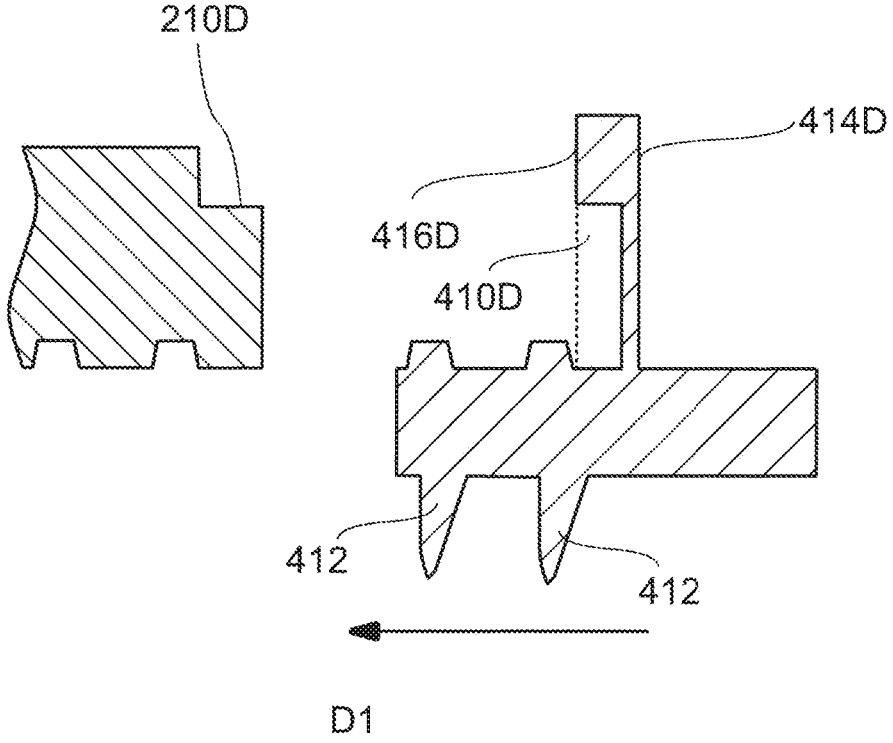
FIG. 9 is a cross-sectional view of a first fitting portion of an antenna base and a second fitting portion of an elastic member in an antenna device in a third the third modification of the first embodiment, in the state before the first fitting portion and the second fitting portion are fit with each other.

In the first embodiment, the first modification and the second modification, the second fitting portions 410, 410A, 410B and 410C are through-holes. The second fitting portion is not limited to being a through-hole. With reference to FIG. 9, the third modification will be described. FIG. 9 is a cross-sectional view of an antenna device in the third modification of the first embodiment; more specifically, a cross-sectional view of a first fitting portion 210D of the antenna base 200 and a second fitting portion 410D of the elastic member 400, in the state before the first fitting portion 210D and the second fitting portion 410D are fit with each other. Regarding the third modification, differences from the first embodiment, the first modification or the second modification will be described, and the components same as those in the first embodiment, the first modification or the second modification will not be described.

As shown in FIG. 9, in the third modification, the second fitting portion 410D is provided at an outer wall 416D but not at an inner wall 414D. Namely, the second fitting portion 410D does not run through the wall portion 415 from the outer wall 416D to the inner wall 414D. Thus, the second fitting portion 410D may be referred to as a "second recessed portions 410D". In this modification also, the adhesiveness between the elastic member 400 and the antenna base 200 is improved, so that generation of a gap between the elastic member 400 and the antenna base 200 is suppressed, or the elastic member 400 is suppressed from being delaminated from the antenna base 200.

In the third modification shown in FIG. 9, the second fitting portion 410D may be obtained by modifying the second fitting portion 410 shown in FIG. 5 such that the second fitting portion 410 is formed to be recessed, instead of being formed to run through the wall portion 415. The same modification may be performed on the second fitting portions 410A, 410B and 410C shown in FIG. 6, FIG. 7 and FIG. 8.

Second Embodiment

Figure 10:
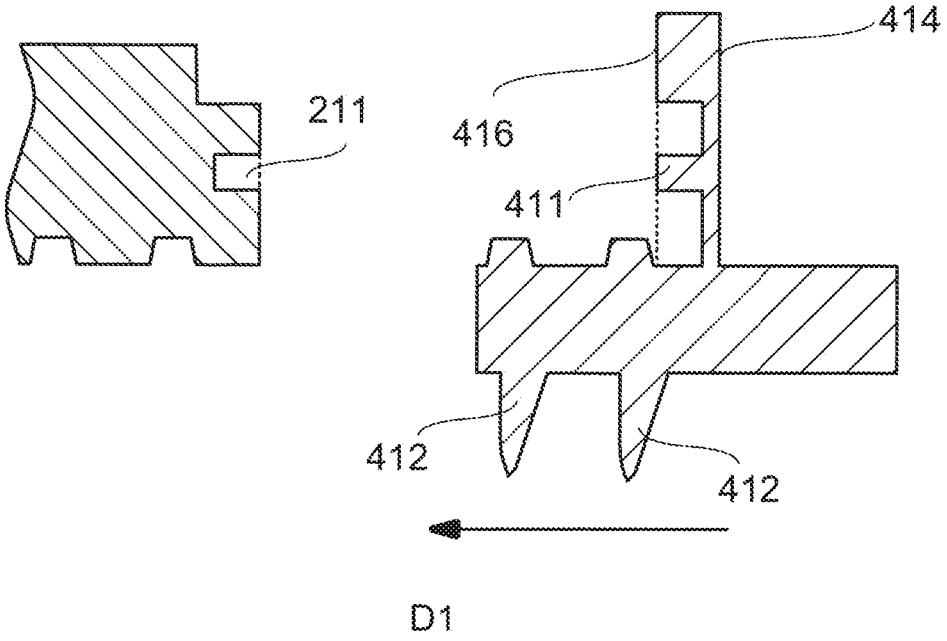
FIG. 10 is a cross-sectional view of a first fitting portion of an antenna base and a second fitting portion of an elastic member in an antenna device in accordance with a second embodiment, in the state before the first fitting portion and the second fitting portion are fit with each other.

In the first embodiment, the first modification, the second modification and the third modification, the first fitting portions 210, 210A, 210B, 210C and 210D are protrusions, whereas the second fitting portions 410, 410A, 410B and 410C are through-holes and the second fitting portion 410D is the second recessed portion. The first fitting portion and the second fitting portion merely need to be fittable with each other, and are not limited to any of the above-described forms. Now, with reference to FIG. 10, an antenna device in the second embodiment will be described. FIG. 10 is a cross-sectional view of the antenna device in the second embodiment according to the present invention; more specifically, a cross-sectional view of a first fitting portion 211 of the antenna base 200 and a second fitting portion 411 of the elastic member 400, in the state before the first fitting portion 211 and the second fitting portion 411 are fit with each other. Regarding the second embodiment, differences from the first embodiment will be described, and the components same as those in the first embodiment will not be described.

The first fitting portion 211 is a recessed portion provided at a side wall of the opening 220 of the antenna base 200. Thus, in this embodiment, the first fitting portion 211 may be referred to as a "first recessed portion 211". The second fitting portion 411 is a protrusion provided at the outer wall 416 of the elastic member 400. Thus, the second fitting portion 411 may be referred to as a "second protrusion 411". The first recessed portion 211 and the second protrusion 411 are, for example, rectangular.

As shown in FIG. 10, the second fitting portion 411 is moved in the D1 direction and is fit into the first fitting portion 211. In this embodiment also, the adhesiveness between the elastic member 400 and the antenna base 200 is improved, so that generation of a gap between the elastic member 400 and the antenna base 200 is suppressed, or the elastic member 400 is suppressed from being delaminated from the antenna base 200.

First Modification of the Second Embodiment

Figure 11:
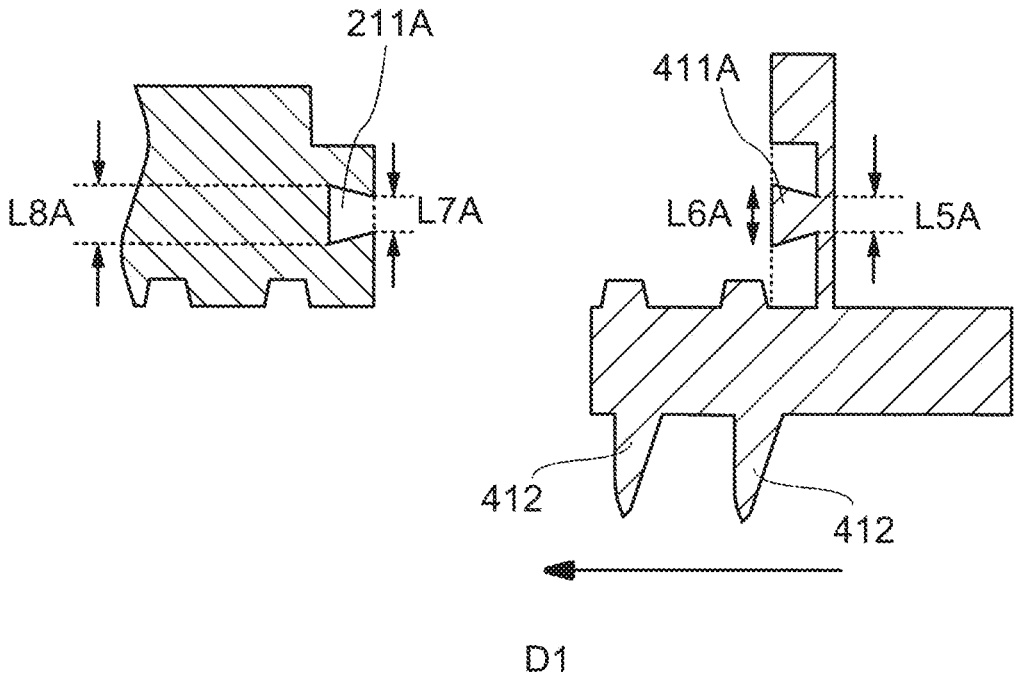
FIG. 11 is a cross-sectional view of a first fitting portion of an antenna base and a second fitting portion of an elastic member in an antenna device in a first modification of the second embodiment, in the state before the first fitting portion and the second fitting portion are fit with each other.

In the second embodiment, as shown the cross-sectional view of FIG. 10, the first fitting portion 211 and the second fitting portion 411, which is a protrusion, are both rectangular. The first fitting portion 211 or the second fitting portion 411 is not limited to being rectangular. With reference to FIG. 11, the first modification of the second embodiment will be described. FIG. 11 is a cross-sectional view of an antenna device in the first modification of the second embodiment; more specifically, a cross-sectional view of a first fitting portion 211A of the antenna base 200 and a second fitting portion 411A of the elastic member 400, in the state before the first fitting portion 211A and the second fitting portion 411A are fit with each other. Regarding the first modification, differences from the second embodiment will be described, and the components same as those in the second embodiment will not be described.

As shown in FIG. 11, in the first modification, as seen in a cross-sectional view, the second fitting portion 411A, which is a protrusion, is trapezoidal. Specifically, as seen in a cross-sectional view, width L6A at a tip end is wider than width L5A at a base end. In other words, the width of the second fitting portion 411A varies in accordance with the position in the D1 direction. Similarly, as seen in a cross-sectional view, the first fitting portion 211A is trapezoidal. Specifically, as shown in a cross-sectional view, width L8A of the first fitting portion 211A at an inner side is wider than width L7A at an outer side. In other words, the width of the first fitting portion 211A varies in accordance with the position in the D1 direction.

Here, width L6A is wider than width L7A. Therefore, in order to cause the first fitting portion 211A and the second fitting portion 411A to be fit with each other, the second fitting portion 411A needs to be pressed in the D1 direction. The second fitting portion 411A is pressed in the D direction, so that the second fitting portion 411A is locked with the first fitting portion 211A and thus is suppressed from coming off from the first fitting portion 211A.

This modification provides substantially the same effect as that of the second embodiment. In addition, in order to cause the second fitting portion 411A and the first fitting portion 211A to be fit with each other, the operator needs to press the second fitting portion 411 in the D1 direction. Therefore, the operator can perceive by touch whether or not the second fitting portion 411A and the first fitting portion 211A are fit with each other.

Second Modification of the Second Embodiment

Figure 12:
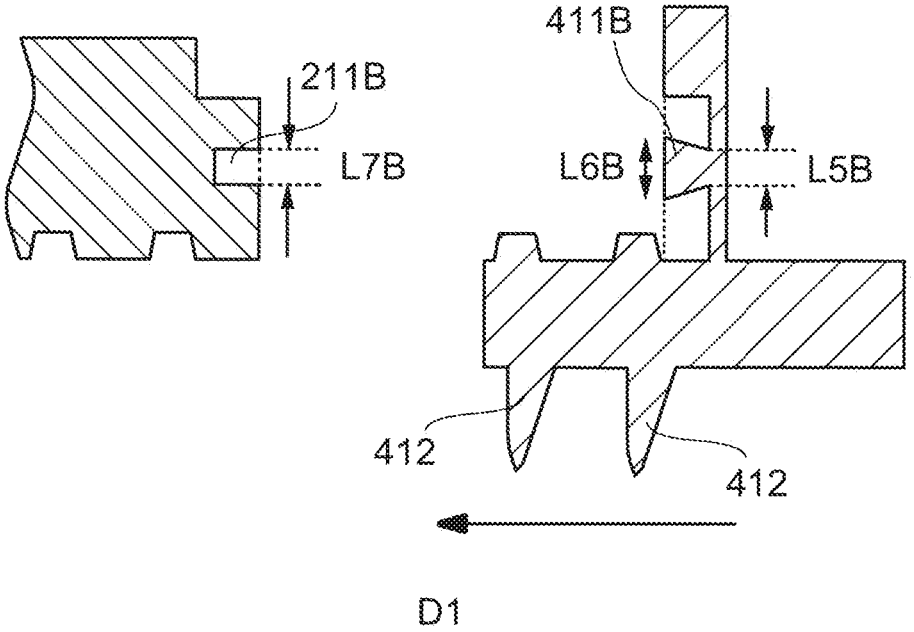
FIG. 12 is a cross-sectional view of a first fitting portion of an antenna base and a second fitting portion of an elastic member in an antenna device in a second modification of the second embodiment, in the state before the first fitting portion and the second fitting portion are fit with each other.
Figure 13:
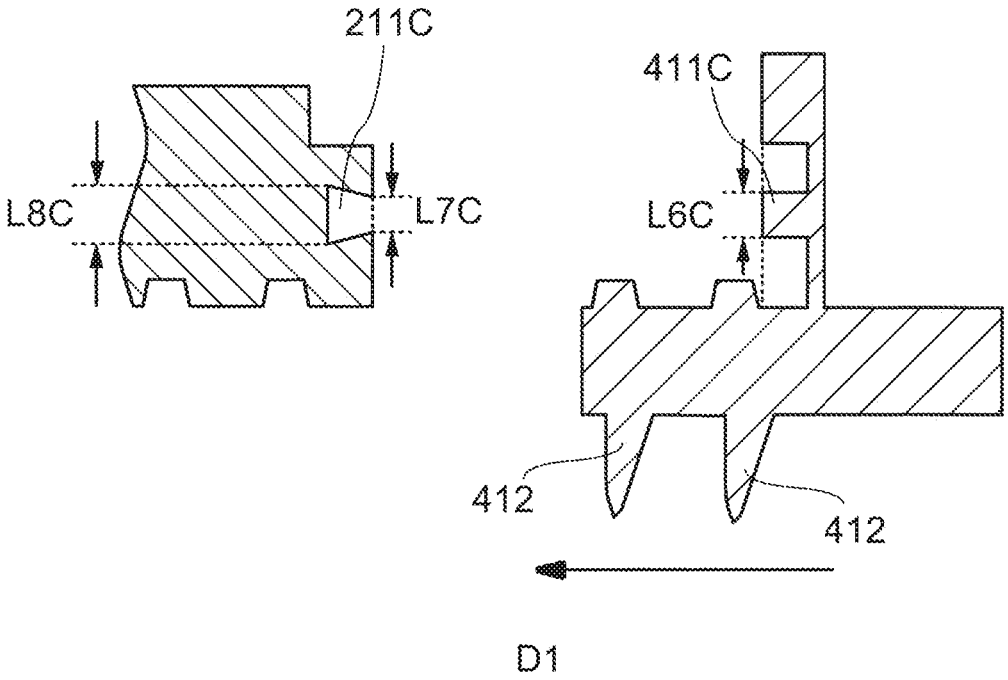
FIG. 13 is a cross-sectional view of a first fitting portion of an antenna base and a second fitting portion of an elastic member in an antenna device in a second modification of the second embodiment, in the state before the first fitting portion and the second fitting portion are fit with each other.

With reference to FIG. 12 and FIG. 13, an antenna device in the second modification of the second embodiment will be described. FIG. 12 is a cross-sectional view of the antenna device in the second modification of the second embodiment; more specifically, a cross-sectional view of a first fitting portion 211B of the antenna base 200 and a second fitting portion 411B of the elastic member 400, in the state before the first fitting portion 211B and the second fitting portion 411B are fit with each other. FIG. 13 is a cross-sectional view of the antenna device in the second modification of the second embodiment; more specifically, a cross-sectional view of a first fitting portion 211C of the antenna base 200 and a second fitting portion 411C of the elastic member 400, in the state before the first fitting portion 211C and the second fitting portion 411C are fit with each other. Regarding the second modification, differences from the first embodiment or the first modification will be described, and the components same as those in the first embodiment or the first modification will not be described.

In this modification, as shown in FIG. 12 and FIG. 13, one of the first fitting portion and the second fitting portion has a width that varies in accordance with the position in the D1 direction. Specifically, in FIG. 12, the width of the second fitting portion 411B varies in accordance with the position in the D1 direction. In FIG. 13, the width of the first fitting portion 211C varies in accordance with the position in the D1 direction. As shown in FIG. 12, width L6B of the second fitting portion 411B at an outer wall is wider than width L7B of the first fitting portion 211B. As shown in FIG. 13, width L6C of the second fitting portion 411C is wider than width L7C at an outer side of the first fitting portion 211C, which is a recessed portion. With such an arrangement, the second fitting portion 411B is elastically deformed to be fit with the first fitting portion 211B, and is recovered from the deformed state when being fit with the first fitting portion 211B. The second fitting portion 411C is elastically deformed to be fit with the first fitting portion 211C, and is recovered from the deformed state when being fit with the first fitting portion 211C. As a result, the second fitting portion 411B is locked with the first fitting portion 211B. The second fitting portion 411C is locked with the first fitting portion 211C. This modification provides substantially the same effect as that of the first modification.

Third Modification of the Second Embodiment

Figure 14:
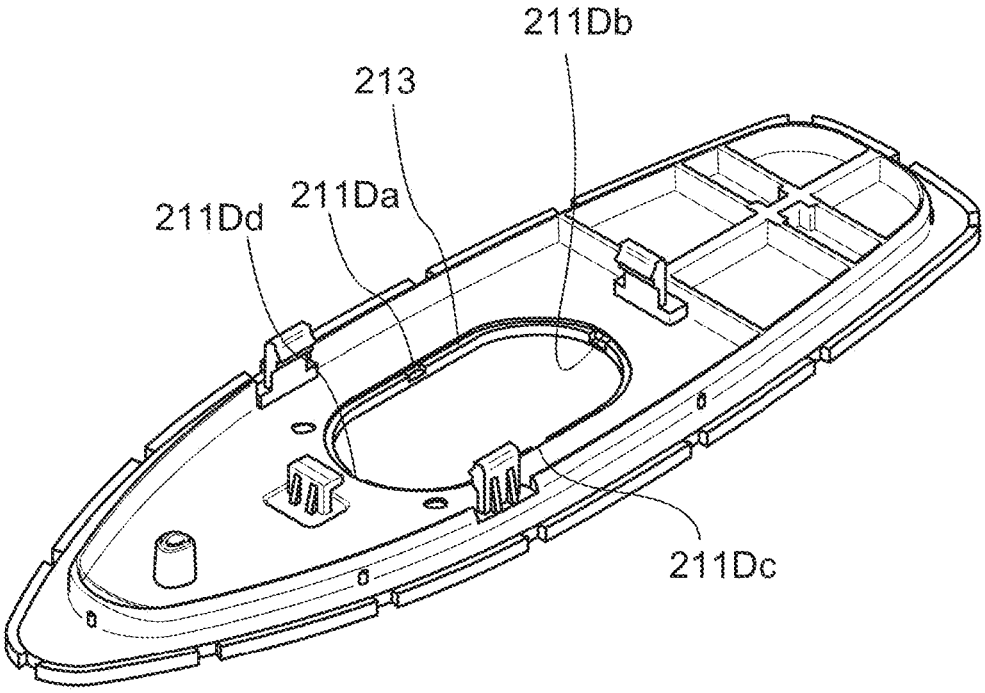
FIG. 14 is a perspective view of an antenna device in a third modification of the second embodiment.
Figure 15:
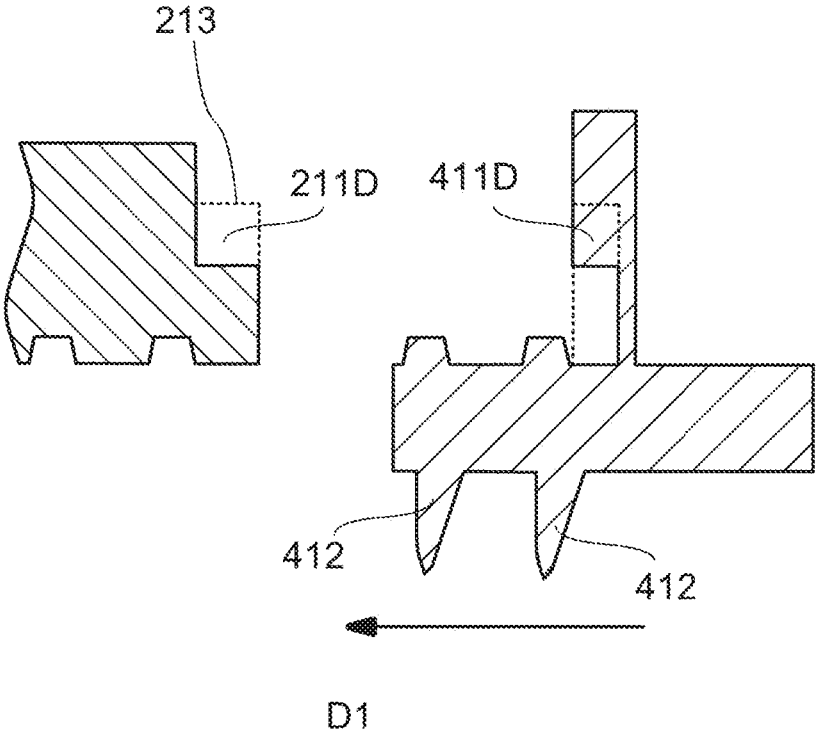
FIG. 15 is a cross-sectional view of a first fitting portion of an antenna base and a second fitting portion of an elastic member in the antenna device in the third modification of the second embodiment, in the state before the first fitting portion and the second fitting portion are fit with each other.

In the second embodiment, the first modification and the second modification, the first fitting portions 211, 211A, 211B and 211C are provided at the side wall of the opening 220. However, the first fitting portion is not limited to being provided at the side wall of the opening 220. With reference to FIG. 14 and FIG. 15, an antenna device in the third modification will be described. FIG. 14 is a perspective view of the antenna device in the third modification of the second embodiment. FIG. 15 is a cross-sectional view of the antenna device in the third modification of the second embodiment; more specifically, a cross-sectional view of a first fitting portion 211D of the antenna base 200 and a second fitting portion 411D of the elastic member 400, in the state before the first fitting portion 211D and the second fitting portion 411D are fit with each other. Regarding the third modification, differences from the first embodiment, the first modification or the second modification will be described, and the components same as those in the first embodiment, the first modification or the second modification will not be described.

As shown in FIG. 14 and FIG. 15, in the third modification, first fitting portions 211Da to 211Dd (hereinafter, referred to as "first fitting portion(s) 211D" in the case where the first fitting portions 211Da to 211Dd are not specifically distinguished from each other) are each provided on the top surface (first surface) side of the antenna base 200, at the side wall of the opening 220. The first fitting portion 211D is recessed from the first groove 213. In this example, the first fitting portion 211D has a rectangular parallelepiped shape. The second fitting portion 411D is provided to be fit into the first fitting portion 211D. Since the first fitting portion 211D has a rectangular parallelepiped shape, the second fitting portion 411D also has a rectangular parallelepiped shape. The first fitting portion 211D or the second fitting portion 411D is not limited to having a rectangular parallelepiped shape. The first fitting portion 211D and the second fitting portion 411D may have any shape as long as being fittable with each other. This modification provides substantially the same effect as that of the second embodiment.

Third Embodiment

In the above-described embodiments (and also the modifications of the embodiments), the plurality of first fitting portions and the plurality of second fitting portions have the same shape so as to be fittable with each other. For example, as shown in FIG. 2, the first fitting portions 210*a* to 210*d* are protrusions of the same shape, and the second fitting portions 410*a* to 410*d* are through-holes of the same shape as that of the first fitting portions 210*a* to 210*d*. The first embodiment and the modifications of the first embodiment and the second embodiment and the modifications of the second embodiment may be combined together. For example, two of the four first fitting portions may have the shape of the first fitting portion 210 shown in FIG. 5, and the remaining two first fitting portions may have the shape of the first fitting portion 211 shown in FIG. 10. Even in the case where the embodiments and the modifications are combined, substantially the same effect as that of the first embodiment and the second embodiment are provided.

Fourth Embodiment

In the above-described embodiments and modifications, an operator causes the first fitting portions and the second fitting portions to be fit with each other. In this case, it is time consuming and costly to cause the first fitting portions and the second fitting portions to be fit with each other. In order to solve this, the antenna base 200 and the elastic member 400 may be integrally formed by molding. In such case also, the adhesiveness between the elastic member 400 and the antenna base 200 is improved.

The present invention is not limited to any of the above-described embodiments and modifications, and may be altered in any way without departing from the gist of the present invention. The embodiments and the modifications may be combined in any way as long as no contradiction occurs.

Even functions and effects that are different from those provided by the above-described embodiments but are obvious from the description of this specification or are easily expectable by a person of ordinary skill in the art are naturally construed as being located by the present invention.

What is claimed is:

1. An antenna device comprising:

an antenna base including an opening and a plurality of first fitting portions located at an interval from each other at a side wall of the opening;

an antenna case secured to a first surface side of the antenna base;

an antenna element located in a space enclosed by the antenna base and the antenna case; and an elastic member including a plurality of second fitting portions fittable with the plurality of first fitting portions and a rib provided on a second surface side opposite to the first surface side and protruding in a direction away from the antenna base.

2. The antenna device according to claim 1, wherein the plurality of first fitting portions of the antenna base are provided on the first surface side, at the side wall of the opening.

3. The antenna device according to claim 1, wherein the plurality of first fitting portions are protrusions provided on the side wall of the opening, and the plurality of second fitting portions are through-holes or recessed portions fittable with the protrusions.

4. The antenna device according to claim 3, wherein the plurality of first fitting portions are locked with the plurality of second fitting portions.

5. The antenna device according to claim 4, wherein the plurality of first fitting portions each have a width varying in accordance with the position in a first direction in which the plurality of second fitting portions are pressed into the plurality of first fitting portions.

6. The antenna device according to claim 4, wherein the plurality of second fitting portions each have a diameter of the through-hole or a width of the recessed portion varying in accordance with the position in a first direction in which the plurality of second fitting portions are pressed into the plurality of first fitting portions.

7. The antenna device according to claim 1, wherein the plurality of first fitting portions are recessed portions provided at the side wall of the opening, and the plurality of second fitting portions are protrusions fittable with the recessed portions.

8. The antenna device according to claim 7, wherein the plurality of second fitting portions are locked with the plurality of first fitting portions.

9. The antenna device according to claim 8, wherein the plurality of first fitting portions each have a width varying in accordance with the position in a first direction in which the plurality of second fitting portions are pressed into the plurality of first fitting portions.

10. The antenna device according to claim 8, wherein the plurality of second fitting portions each have a width varying in accordance with the position in a first direction in which the plurality of second fitting portions are pressed into the plurality of first fitting portions.

11. An antenna device comprising:

an antenna base including an opening and a plurality of first fitting portions located at an interval from each other at a side wall of the opening;

an antenna case secured to a first surface side of the antenna base;

an antenna element located in a space enclosed by the antenna base and the antenna case; and an elastic member including a wall portion located to face the side wall of the opening, a plurality of second fitting portions located at the wall portion so as to be fittable with the plurality of first fitting portions, and a rib provided to enclose the wall portion as seen in a plan view.

12. The antenna device according to claim 11, further comprising a ground base located in the space, a part of the elastic member being located between the antenna base and the ground base.

13. The antenna device according to claim 11, wherein the plurality of first fitting portions are protrusions provided on the side wall of the opening, and the plurality of second fitting portions are through-holes or recessed portions fittable with the protrusions.

14. The antenna device according to claim 13, wherein the plurality of first fitting portions are locked with the plurality of second fitting portions.

15. The antenna device according to claim 14, wherein the plurality of first fitting portions each have a width varying in accordance with the position in a first direction in which the plurality of second fitting portions are pressed into the plurality of first fitting portions.

16. The antenna device according to claim 14, wherein the plurality of second fitting portions each have a diameter of the through-hole or a width of the recessed portion varying in accordance with the position in a first direction in which the plurality of second fitting portions are pressed into the plurality of first fitting portions.

17. The antenna device according to claim 11, wherein the plurality of first fitting portions are recessed portions provided at the side wall of the opening, and the plurality of second fitting portions are protrusions fittable with the recessed portions.

18. The antenna device according to claim 17, wherein the plurality of second fitting portions are locked with the plurality of first fitting portions.

19. The antenna device according to claim 18, wherein the plurality of first fitting portions each have a width varying in accordance with the position in a first direction in which the plurality of second fitting portions are pressed into the plurality of first fitting portions.

20. The antenna device according to claim 18, wherein the plurality of second fitting portions each have a width varying in accordance with the position in a first direction in which the plurality of second fitting portions are pressed into the plurality of first fitting portions.

* * * * *